US005964128A

United States Patent [19]

Kaneyama et al.

[11] Patent Number: 5,964,128

[45] Date of Patent: Oct. 12, 1999

[54] BOLT TIGHTENING DEVICE

[75] Inventors: Yasunobu Kaneyama, Osaka; Daijiro Yano, Tondabayashi; Shozo Matsumura; Kenji Sato, both of Toyonaka, all of Japan

[73] Assignee: Maeda Metal Industries, Ltd., Japan

[21] Appl. No.: 09/131,498

[22] Filed: Aug. 1, 1998

[30] Foreign Application Priority Data

Aug. 20, 1997 [JP] Japan ..... 9-223259

[51] Int. Cl.[6] ..... B25B 17/00

[52] U.S. Cl. ..... 81/56; 81/55; 81/57.36; 81/57.22

[58] Field of Search ..... 81/55, 56, 57.36, 81/57.22

[56] References Cited

U.S. PATENT DOCUMENTS 5,490,439 2/1996 Matsumura et al. ..... 81/469

5,582,079 12/1996 Matsumura et al. ..... 81/56

5,699,702 12/1997 Myers ..... 81/56

*Primary Examiner*—David A. Scherbel

*Assistant Examiner*—Shantese McDonald

*Attorney, Agent, or Firm*—Bracewell & Patterson, L.L.P.

[57] ABSTRACT

A bolt tightening device for tightening torque controlled bolts each having at one end thereof a tip to be sheared has an outer socket engageable with a nut, and an inner socket engageable with the tip, the inner socket being axially slidable relative to the outer socket and biased outward by a spring, the two sockets being coupled to planetary gear mechanisms for delivering opposed torques to the respective sockets, a knockout pin extending into the inner socket for forcibly removing the bolt tip as sheared. The knockout pin for knocking out the sheared bolt tip is made contractable by being composed of a shank and a head provided on the shank and biased outward of the shank by a spring, The length of backward stroke of the knockout pin required for knocking out the tip is minimized by contracting the pin to thereby shorten the length of the device.

1 Claim, 7 Drawing Sheets

BOLT TIGHTENING DEVICE

FIELD OF THE INVENTION

The present invention relates to a bolt tightening device for tightening up torque controlled bolts each having at one end a tip to be sheared.

BACKGROUND OF THE INVENTION

FIG. 7 shows a tightening device previously proposed by the present applicant and designed specifically for use with torque controlled bolts.

The tightening device comprises an outer socket 3 and an inner socket 4 which are provided concentrically at the front end of a casing 1, a plurality of planetary gear mechanisms 2 housed in the casing 1 for delivering opposed torques to the respective sockets 3, 4, and a handle 11 and a prime mover 12 which are arranged outside the casing 1.

The planetary gear mechanisms 2 are coupled to the prime mover 12 via a gear train 13 including a bevel gear.

A knockout pin 5a slidable axially thereof extends through the gear mechanisms 2 and has a forward end retractably fitting in the inner socket 4.

To use the tightening device, the device is pressed against a bolt 8 and a nut 82 pretightened thereon, axially of the bolt as seen in FIG. 8. A tip 81 at the distal end of the bolt 8 fits into the inner socket 4 and comes into contact with the knockout pin 5*a*, retracting the pin 5*a* against a spring 50 biasing the pin 5*a* outward, i.e., forward. By being pushed by the bolt tip 81, the inner socket 4 is also retracted against a spring 40 biasing the socket 4 outward.

When the nut 82 fits into the outer socket 3, the outer socket 3 is rotated by actuating the prime mover 12.

The force rotating the outer socket 3 is transmitted as reversed in the direction of rotation to the inner socket 4, delivering to the bolt tip 81 a reaction to the torque of the nut 82.

Upon the force tightening the nut 82 increasing to a required value, the resulting reaction exerts a torsional force on the bolt tip 81, shearing the tip 81 along a circumferential groove 80 at the base portion thereof.

Consequently, the inner socket 4 becomes unable to receive the reaction to the nut rotating force, and the nut 82 comes to a halt, permitting the inner socket 4 to rotate free of load, whereby the nut 82 is completely tightened up on the bolt 8.

The switch for the prime mover 12 is turned off, and the tightening device is moved away from the bolt axially thereof.

As the device is thus moved away, the inner socket 4 is forced outward by the spring 40 with the sheared bolt tip 81 fitting therein, and comes to a stop upon striking on a stopper 31 within the outer socket 3.

The knockout pin 5*a* also moves forward under the action of the spring 50, following the inner socket 4, whereas an engaging portion 59 of the knockout pin 5*a* comes into engagement with a latch member 6 upon reaching the position of the latch member 6, whereby the knockout pin 5*a* is restrained from advancing despite a further advance of the inner socket 4.

When the knockout pin 5*a* is disengaged from the latch member 6 by manipulating release means 7, the pin 5*a* instantaneously advances under the action of the spring 50, knocking out the tip 81 from inside the inner socket 4. The device is now ready for the subsequent tightening operation.

It is required that the bolt tightening device be reduced in weight and in length so as to be convenient to use, whereas the device is not always usable because the length of the device from the forward end of the outer socket 3 to a closure 14 at the rear end of the casing 1 is slightly greater relative to the work space available.

With the conventional bolt tightening device, the closure 14 at the rear end of the casing 1 needs to be formed with an escape bore 15 corresponding to the distance of retraction of the knockout pin 5*a* for permitting the rear end portion of the pin 5*a* to move in. Accordingly it is necessary to increase the thickness of the closure 14 by an amount corresponding to the depth of the escape bore 15 and give an increased length to the device.

It is physically impossible to overcome this drawback insofar as the knockout pin 5*a* is used which is in the form of an integral piece and which slidably extends through the planetary gear mechanisms 2.

An object of the present invention is to provide a bolt tightening device wherein the knockout pin itself is contractable so as to minimize the sliding distance of the rear end of the pin and to reduce the length and weight of the device.

SUMMARY OF THE INVENTION

The present invention provides a bolt tightening device for tightening torque controlled bolts each having at one end thereof a tip to be sheared, the device having an outer socket engageable with a nut, and an inner socket engageable with the tip, the inner socket being axially slidable relative to the outer socket and biased outward by a spring, the two sockets being coupled to planetary gear mechanisms for delivering opposed torques to the respective sockets, a knockout pin extending into the inner socket for forcibly removing the bolt tip as sheared. The knockout pin is made contractable by being composed of a shank slidably extending through the planetary gear mechanisms coaxially therewith, and a head slidably provided on a forward end of the shank and prevented from slipping off therefrom, the head being biased outward of the shank by a spring, the shank being provided at a rear end thereof with an engaging portion engageable with and disengageable from a latch member for holding the shank in a retracted limit position, release means being coupled to the latch member for releasing the engaging portion of the knockout pin from engagement with the latch member.

DETAILED DESCRIPTION OF THE INVENTION

Figure 1:
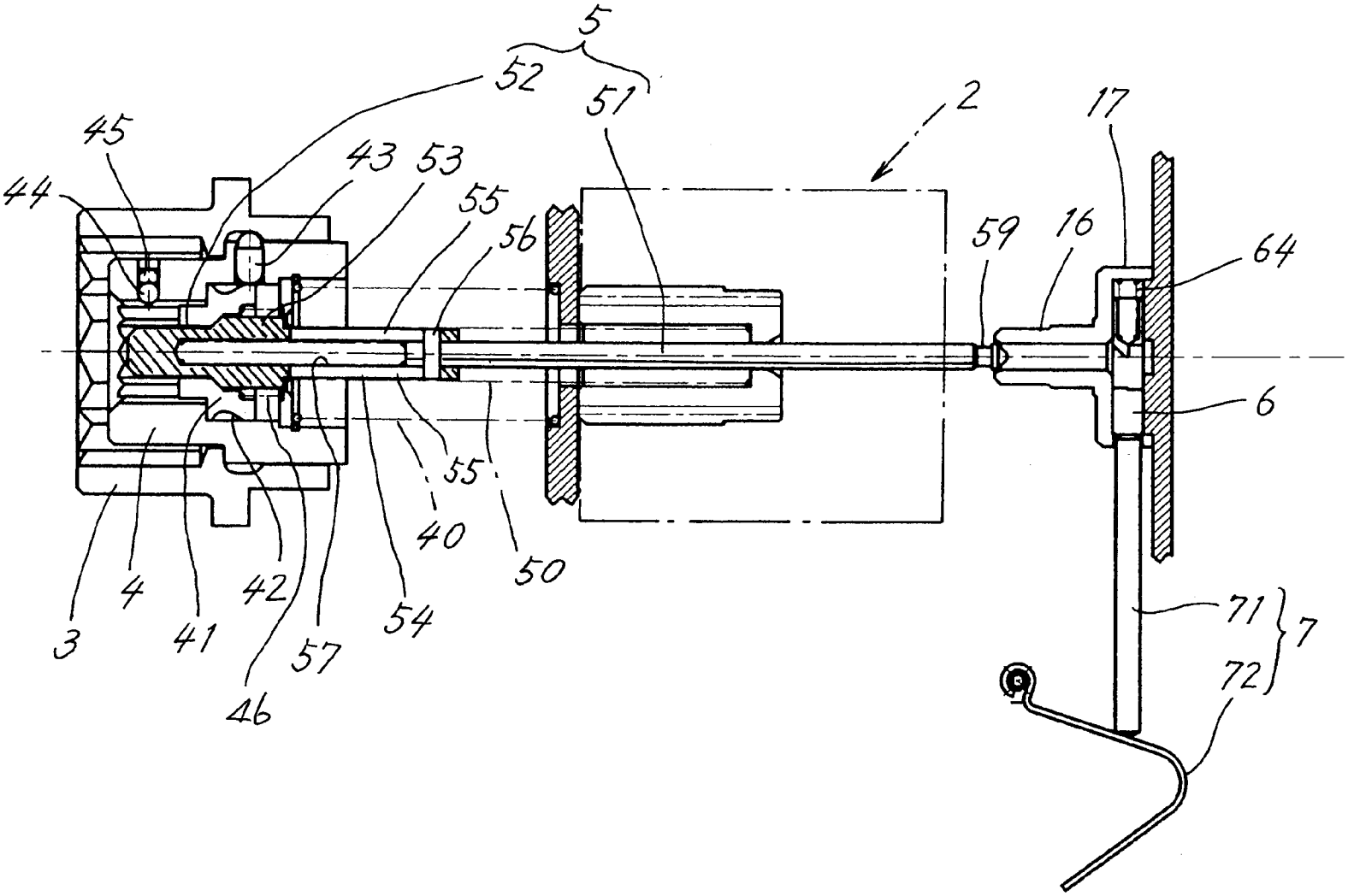
FIG. 1 is a fragmentary view in section of a tightening device of the invention.
Figure 2:
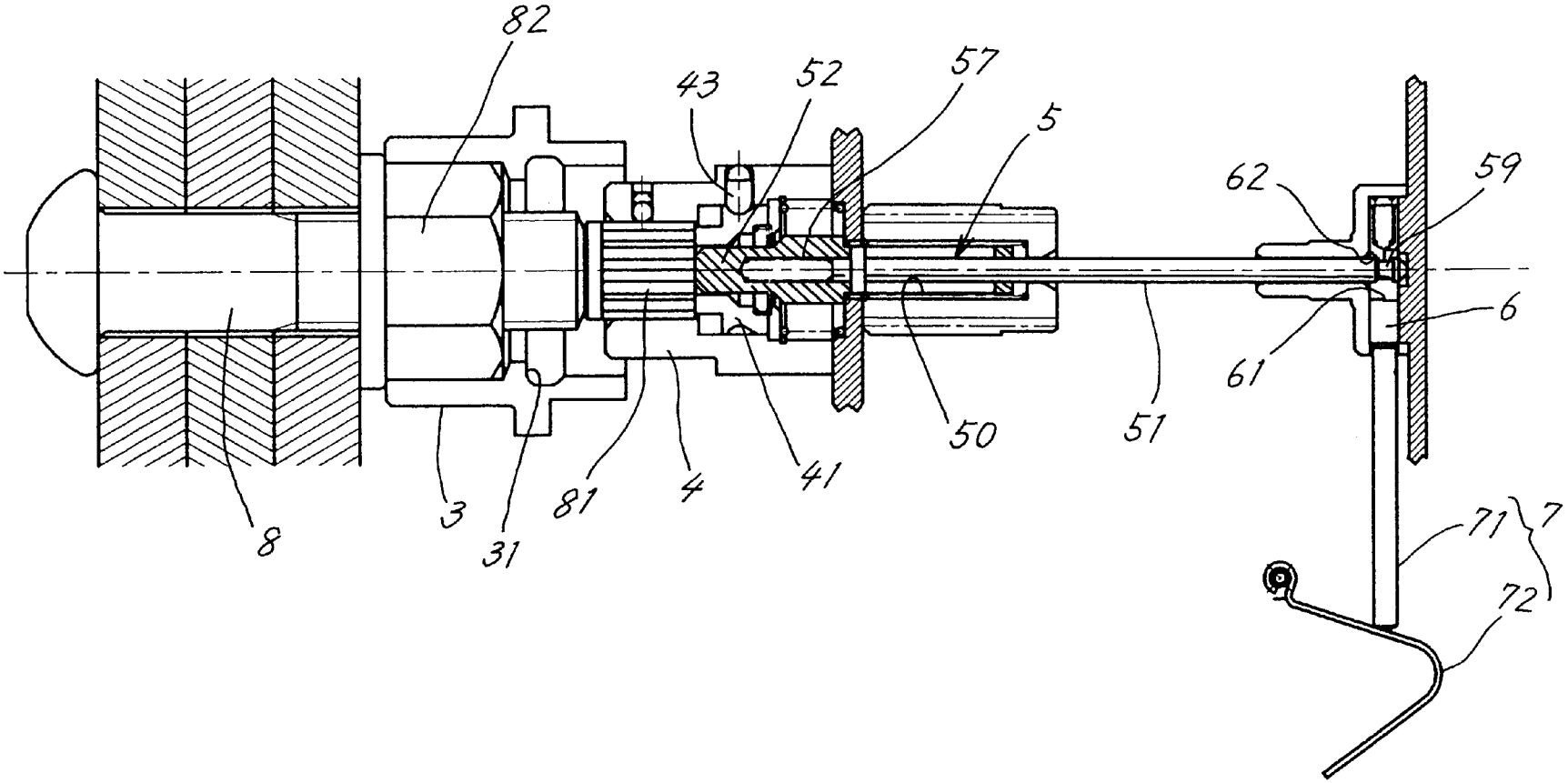
FIG. 2 is a sectional view showing the device as engaged with a bolt and a nut.
Figure 3:
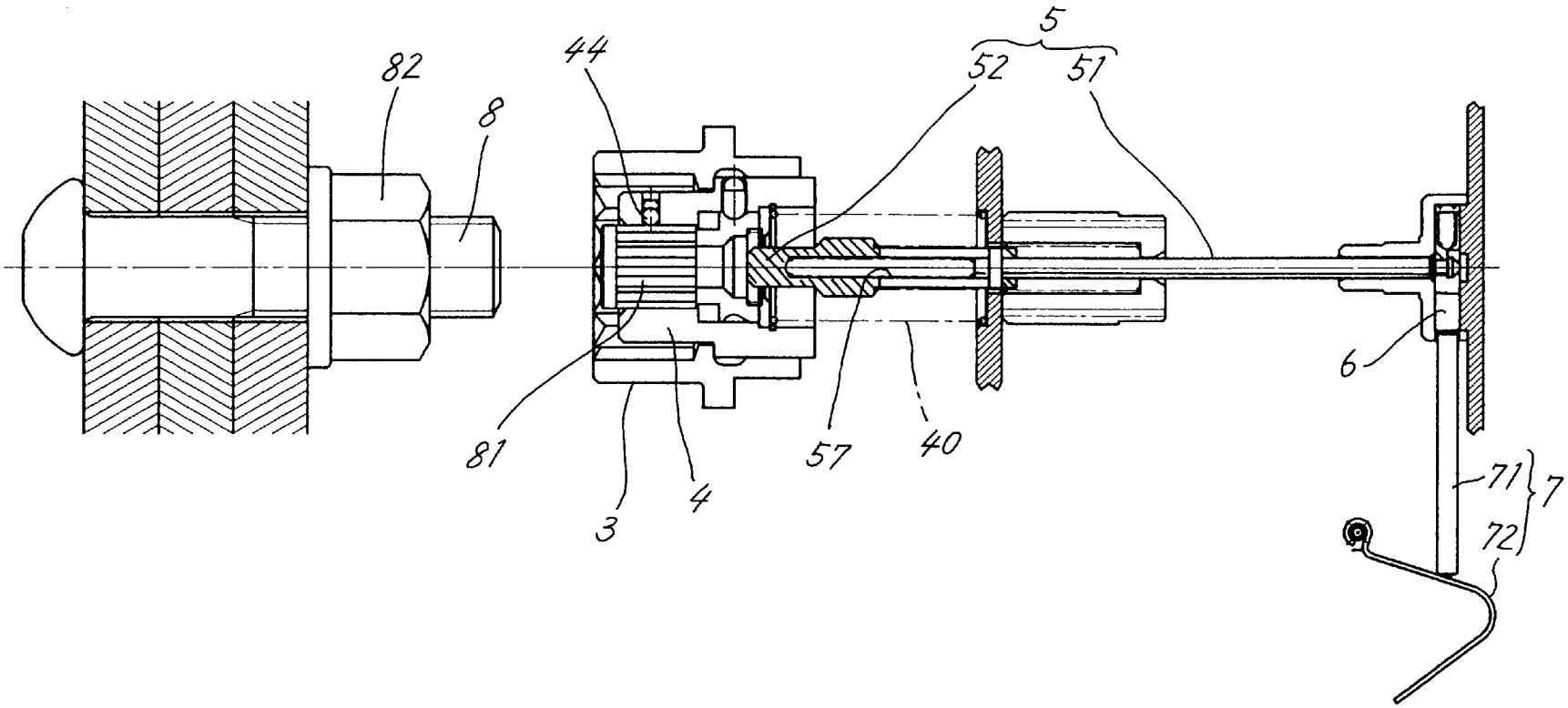
FIG. 3 is a sectional view showing the device with a sheared bolt tip held therein.
Figure 7:
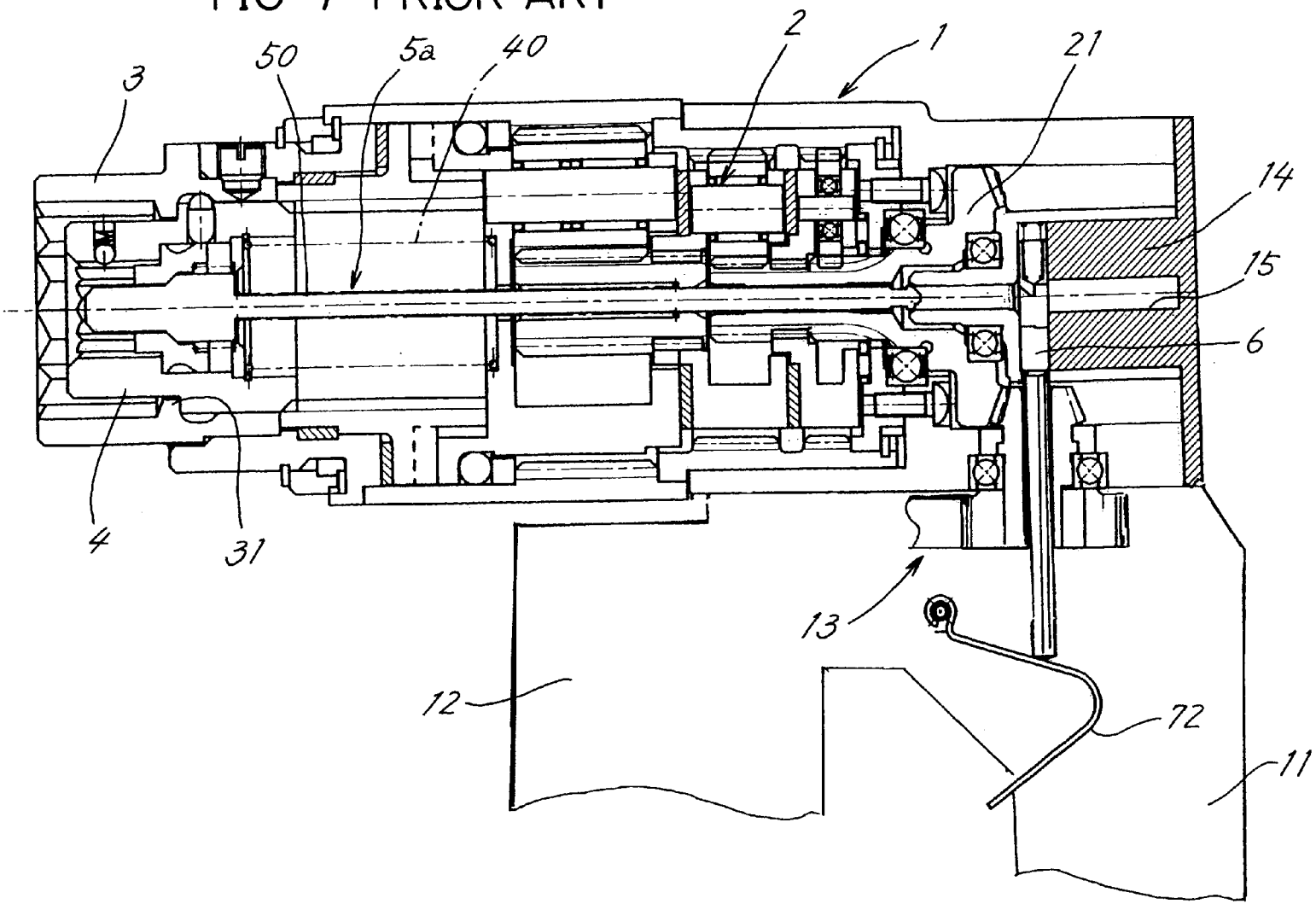
FIG 7 PRIOR ART
FIG. 7 is a sectional view of a bolt tightening device previously proposed by the present applicant.
Figure 8:
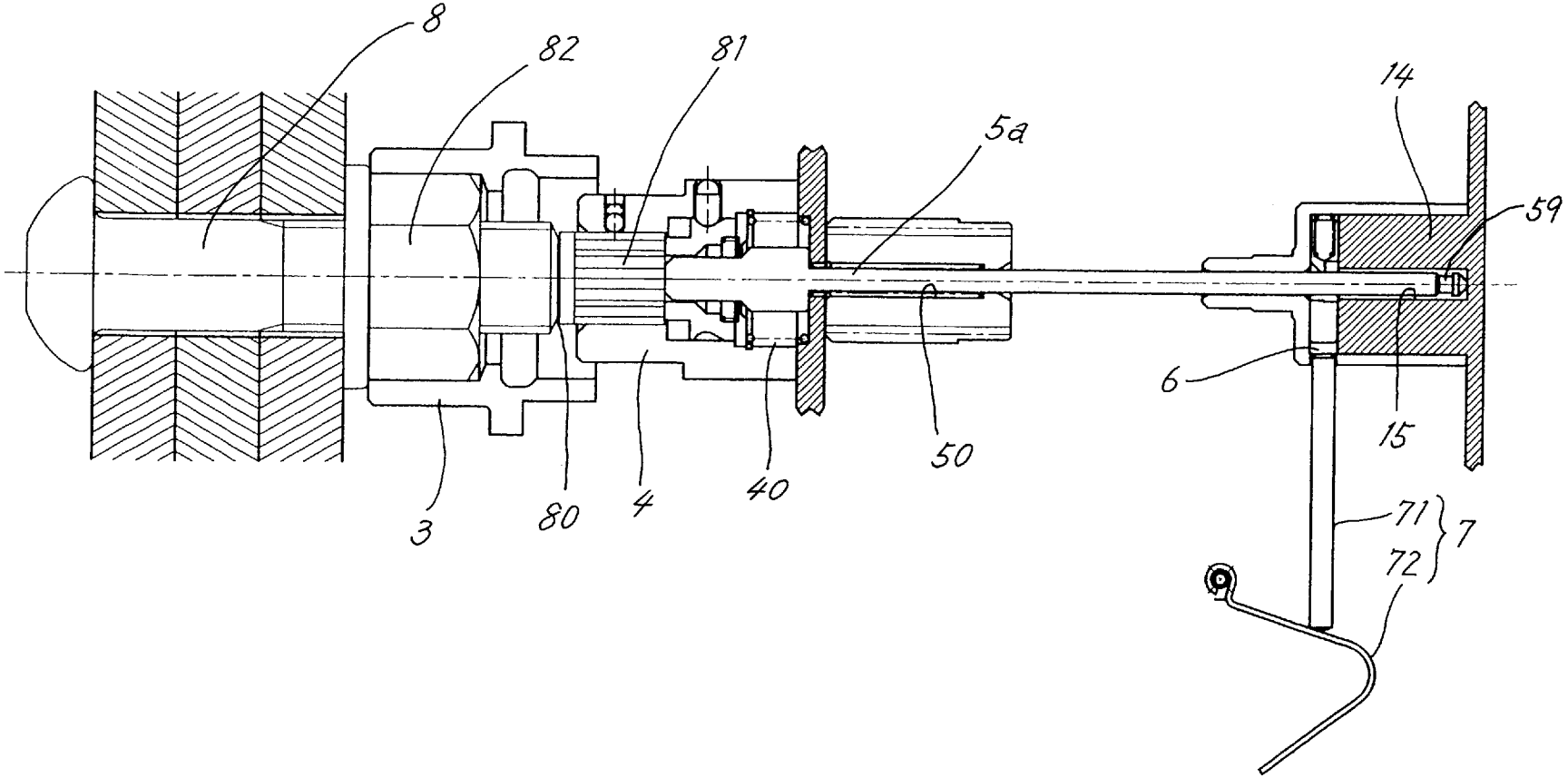
FIG. 8 PRIOR ART
FIG. 8 is a fragmentary view in section showing the device as engaged with a bolt and a nut.

FIGS. 1 to 3 are fragmentary views of the device of the invention; the parts not shown in FIGS. 1 to 3 are the same as in the conventional example shown in FIG. 7.

The tightening device comprises an outer socket 3 and an inner socket 4 which are provided concentrically at the front end of a casing 1, a plurality of planetary gear mechanisms 2 housed in the casing 1 for delivering opposed torques to the respective sockets 3, 4, and a handle 11 and a prime mover 12 which are arranged outside the casing 1.

The planetary gear mechanisms 2 are coupled to the prime mover 12 via a gear train 13 including a bevel gear.

The inner socket 4 is biased outward (forward) by a spring 40 into contact with a stopper 31 on the inner surface of the outer socket 3, whereby the socket 4 is held in a standby position.

Projecting from the inner surface of the inner socket 4 is a holding ball 44 biased by a spring 45. The holding ball 44 serves to hold a sheared bolt tip 81 in the inner socket 4 as described above.

A known slide preventing member 41 is slidably disposed in a rear portion of the inner socket 4 and biased forward by a spring 46.

The slide preventing member 41 is formed in its outer peripheral surface with a recess 42 having releasably fitted therein an engaging piece 43 extending through the wall of the inner socket 4.

A knockout pin 5 is slidably disposed on the axis of the inner socket 4.

The knockout pin 5 comprises a shank 51, a head 52 provided on the front end of the shank 51 and slidable relative to the shank 51, and a spring 57 for biasing the head 52 outward.

Figure 4:
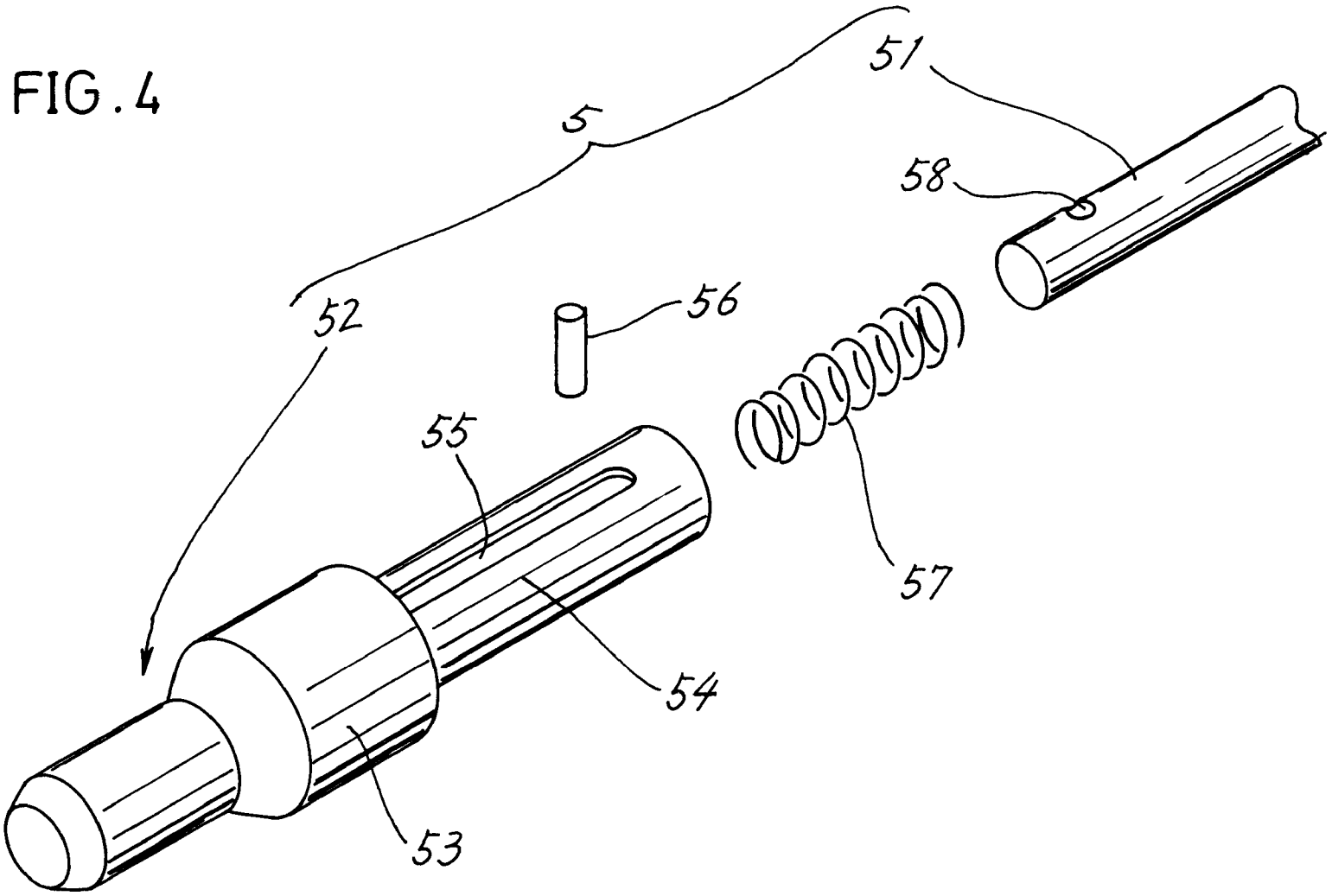
FIG. 4 is an exploded perspective view of a knockout pin.

With reference to FIG. 4, the head 52 has a large-diameter portion 53 at its midportion, and a tubular portion 54 at its rear part. The tubular portion 54 has the spring 57 accommodated therein and the front end of the shank 51 slidably inserted therein. The tubular portion 54 is formed with slits 55, 55 extending axially thereof and diametrically opposed to each other. A retainer pin 56 forcibly inserted through a hole 58 formed in a front end portion of the shank 51 and orthogonal to its axis has its opposite ends slidably fitted in the respective slits 55, 55 for preventing the shank 51 from slipping out of the tubular portion 54.

The shank 51 slidably extends through the planetary gear mechanisms 2 coaxially therewith and has its rear end fitted in a guide sleeve 16 secured to a closure 14 of the casing 1. The shank rear end has an engaging portion 59 in the form of a circumferential groove.

The guide sleeve 16 has a base end providing a hollow mount portion 17 of large diameter. Disposed inside the mount portion 17 is a latch member 6 engageable with and disengageable from the engaging portion 59 of the knockout pin 5 and slidable across the axis of the guide sleeve 16 at right angles therewith.

Figure 5:
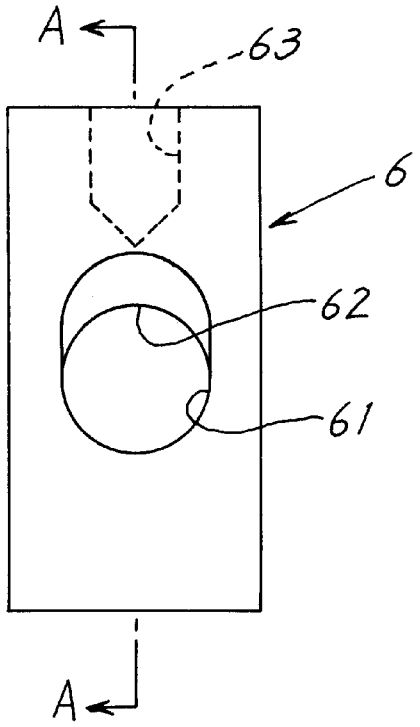
FIG. 5 is a front view of a latch member.
Figure 6:
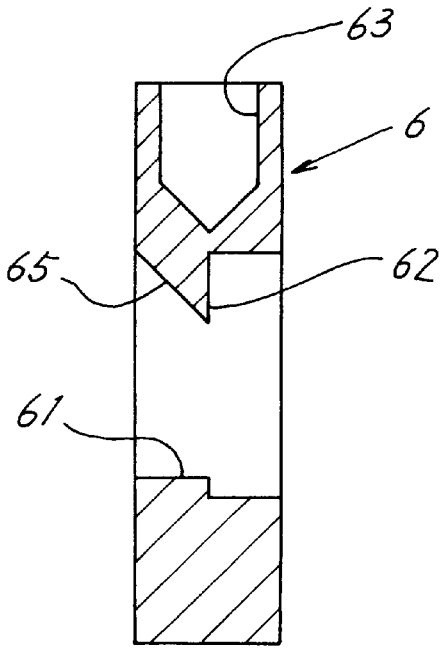
FIG. 6 is a view in section taken along the line A—A in FIG. 5.

As shown in FIGS. 5 and 6, the latch member 6 is in the form of a vertically elongated rectangular plate and formed in its center with a bore 61 permitting the passage of Age the shank 51 of the knockout pin 5 therethrough. A claw 62 engageable with the engaging portion 59 of the shank 51 is provided on the upper portion of the surface defining the bore 61. The claw 62 has a face 65 opposed to the knockout pin 5 and slanting in such a direction as to permit the pin shank 51 to advance into the bore 61.

The latch member 6 is biased downward by a spring 64.

A pushing-up pin 71 bears against the lower end of the latch member 6. The pushing-up pin 71 and a trigger 72 for raising the pushing-up pin 71 against the spring 64 provide release means 7 for disengaging the latch member 6 from the engaging portion 59 of the knockout pin 5.

With reference to FIG. 1 showing the tightening device before engagement with a bolt and a nut, the front end of the head 52 of the knockout pin 5 extends through the slide preventing member 41 and is positioned in the front end of the outer socket 3, and the rear end of the shank 51 is slightly inserted in the front end of the guide sleeve 16.

The tightening device is pressed against the bolt 8 and the nut 82 pretightened thereon, axially of the bolt. A tip 81 at the distal end of the bolt 8 advances into the inner socket 4, pushing the head 52 of the knockout pin 5 and also pushing the slide preventing member 41 to permit the engaging piece 43 to engage in the recess 42 of the preventing member 41, whereby the inner socket 4 restrained from retracting by the engaging piece 43 is released from the restraint.

The knockout pin 5 retracts against the spring 50. The inner socket 4 also retracts against the spring 40 by being pushed by the tip 81 of the bolt 8.

When the knockout pin 5 retracts, the shank rear end of the pin comes into contact with the slanting face 65 of the claw 62 of the latch member 6 in a standby position, pushing up the latch member 6 against the spring 64. When the groove-like engaging portion 59 of the pin 5 is opposed to the claw 62, the claw 62 fits into the engaging portion 59 for engagement.

When the head 52 is further pushed by the bolt tip 81, the shank 51 of the knockout pin 5 comes into contact with the closure 14 and is prevented from retracting further, so that the head 52 slides on the shank 51 to retract against the spring 57. This shortens the overall length of the knockout pin 5.

When the nut 82 fits into the outer socket 3, the prime mover 12 is turned on, tightening up the nut on the bolt and shearing the tip 81.

When the tightening device is moved away from the bolt and the nut as shown in FIG. 3, the inner socket 4 advances under the action of the spring 40, returning to the initial position within the outer socket 3 while holding the tip 81 in the socket 4.

By being biased by the springs 50, 57, the knockout pin 5 also advances following the inner socket 4, whereas since the shank 51 is held in its retracted position, the knockout pin 5 stops advancing despite a further advance of the inner socket 4 when the head 52 is brought forward to the greatest possible extent.

The trigger 72 of the release means 7 is manipulated to cause the pushing-up pin 71 to lift the latch member 6. The claw 62 of the latch member 6 moves out of engagement with the engaging portion 59 of the knockout pin 5, freeing the pin 5 in its retracted position from restraint. The knockout pin 5 is instantaneously advanced by the force of the spring 50, knocking out the tip 81 from inside the inner socket 4. The device is ready for the subsequent tightening operation.

When the inner socket 4 retracts with the bolt tip 81 fitting therein, the pin 5 diminishes in its entire length as described above, consequently reducing the space needed for the retraction of the shank 51 of the knockout pin 5. Since it is not necessary to provide a large space as needed for the retraction of the conventional knockout pin 5*a* in the form of an integral piece, the axial length of the device including the outer socket 3 can be shortened, with a corresponding reduction achieved in weight.

The device of the invention is not limited to the foregoing embodiment in construction but can be modified variously within the scope defined in the appended claim.

What is claimed is:

1. A bolt tightening device for tightening torque controlled bolts each having at one end thereof a tip to be sheared, the device having an outer socket engageable with a nut, and an inner socket engageable with the tip, the inner socket being axially slidable relative to the outer socket and biased outward by a spring, the two sockets being coupled to planetary gear mechanisms for delivering opposed torques to the respective sockets, a knockout pin extending into the inner socket for forcibly removing the bolt tip as sheared, the device being characterized in that the knockout pin is made contractable by being composed of a shank slidably extending through the planetary gear mechanisms coaxially therewith, and a head slidably provided on a forward end of the shank and prevented from slipping off therefrom, the head being biased outward of the shank by a spring, the shank being provided at a rear end thereof with an engaging portion engageable with and disengageable from a latch member for holding the shank in a retracted limit position, release means being coupled to the latch member for releasing the engaging portion of the knockout pin from engagement with the latch member.

* * * * *